US008887653B2

(12) United States Patent
Rogerson

(10) Patent No.: US 8,887,653 B2
(45) Date of Patent: Nov. 18, 2014

(54) SELF LEVELING DRY DOCK LIFT

(76) Inventor: L. Keith Rogerson, Isle of Palms, SC (US)

( * ) Notice: Subject to any disclaimer, the term of this patent is extended or adjusted under 35 U.S.C. 154(b) by 167 days.

(21) Appl. No.: 13/606,509

(22) Filed: Sep. 7, 2012

(65) Prior Publication Data

US 2014/0069310 A1 Mar. 13, 2014

(51) Int. Cl.
*B63C 1/02* (2006.01)

(52) U.S. Cl.
USPC ..... 114/45

(58) Field of Classification Search
USPC ..... 114/45, 125
IPC ..... B63C 1/06; B63B 39/03
See application file for complete search history.

(56) References Cited

U.S. PATENT DOCUMENTS

| | | | | |
|---|---|---|---|---|
| 3,991,695 | A | 11/1976 | McDonald | |
| 4,072,119 | A | 2/1978 | Williams | |
| 4,615,289 | A * | 10/1986 | Bloxham | 114/45 |
| 5,002,000 | A * | 3/1991 | Rutter | 114/45 |
| 5,477,797 | A * | 12/1995 | Stuart | 114/65 R |
| 6,848,380 | B1 | 2/2005 | Sainz | |
| 2004/0011265 | A1 * | 1/2004 | Pastore | 114/125 |

* cited by examiner

*Primary Examiner* — Stephen Avila
(74) *Attorney, Agent, or Firm* — Thrive IP; Bernard S. Klosowski, Jr.

(57) ABSTRACT

An air direction device is submerged under a dry dock. The device imitates the orientation of the dry dock and is in communication with an air source, which pipes air under the device. The air travels to the most elevated portion of the device, which in turn directs the air into a depressed tank to correct dry dock imbalance.

20 Claims, 9 Drawing Sheets

SELF LEVELING DRY DOCK LIFT

BACKGROUND OF THE DISCLOSURE

Many conventional dry docks use air-supplied systems operated by an assortment of valves and switches. These systems are labor intensive and difficult to use. For instance, mechanical friction in the valves can prevent the systems from functioning smoothly. On the other hand, automatic systems are relatively expensive and are often unreliable. Many boat owners and dry dock operators, therefore, choose to use winches and other manual devices to raise vessels out of water.

What is needed in the industry is a dry dock system that is cost effective, easy to manufacture, and simple to use.

BRIEF SUMMARY OF THE DISCLOSURE

The present disclosure is directed broadly to dry dock systems that automatically raise and level watercraft. In general, raising and leveling a boat is accomplished by a submerged arrangement, which is in communication with dry dock tanks. The arrangement may be positioned or mounted below the dry dock tanks in such a way as to emulate the orientation of the dry dock tanks to direct air to fill appropriate tanks in order to level and raise the dry dock. The components of the disclosed embodiments and their equivalents are simple to manufacture, install and use.

For example, in one embodiment according to the present disclosure, a dry dock stabilizer includes a flotation chamber and an air transfer device in communication with an air source. The air transfer device is positioned near the flotation chamber in water and defines an enclosure configured to mimic an orientation of the flotation chamber. The flotation chamber and the air transfer device, when imbalanced, have respective higher and lower points. Air moves naturally to the higher point and is piped, or uses ramps or the like, to move the air to the lowest tank.

By way of further example, a self-leveling docking system may include one or more flotation chambers and an air direction system disposed proximate the flotation chambers. The air direction system includes an air dispersion plate sympathetically oriented with the flotation chambers and in fluid communication therewith. The air dispersion plate may include a rim for guiding air from an air supply and for directing the air to at least one of the flotation chambers located at a water level lower than the other flotation chambers.

In another aspect of the disclosure, a self-leveling flotation system may include a plurality of flotation chambers disposed in a body of water with means for guiding air from an air supply to at least one of the flotation chambers. The means for guiding may be located on or near the flotation chambers and may be move or orient according to an orientation of the flotation chambers such that the air travels from a high point of the means for guiding to the lowest of the flotation chambers.

The means for guiding may be an enclosure and may further include a shield connected to the enclosure. The shield may have an aperture to permit water entry but is sized to prevent growth of marine life. This aspect of the disclosure may also include a depth setting device located in at least one of the flotation chambers. Water will hydraulically lock ("hydro-lock") the depth setting device to halt transfer of air out of tanks and to limit sinking of the flotation chambers.

In another aspect of the disclosure, a method of dry docking a vessel may include positioning a water vessel proximate a flotation tank in water; providing a self-leveling device in communication with the flotation tank; and directing air through the self-leveling device to a high point defined by the self-leveling device and to a lowest point in the flotation tank.

Additional aspects of the present subject matter are set forth in, or will be apparent to, those of ordinary skill in the art from the detailed description herein. Also, it should be further appreciated that modifications and variations to the specifically illustrated, referred and discussed features and elements hereof may be practiced in various embodiments and uses of the disclosure without departing from the spirit and scope of the subject matter. Variations may include, but are not limited to, substitution of equivalent means, features, or steps for those illustrated, referenced, or discussed, and the functional, operational, or positional reversal of various parts, features, steps, or the like. Those of ordinary skill in the art will better appreciate the features and aspects of such variations upon review of the remainder of the specification.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE DISCLOSURE

Figure 1:
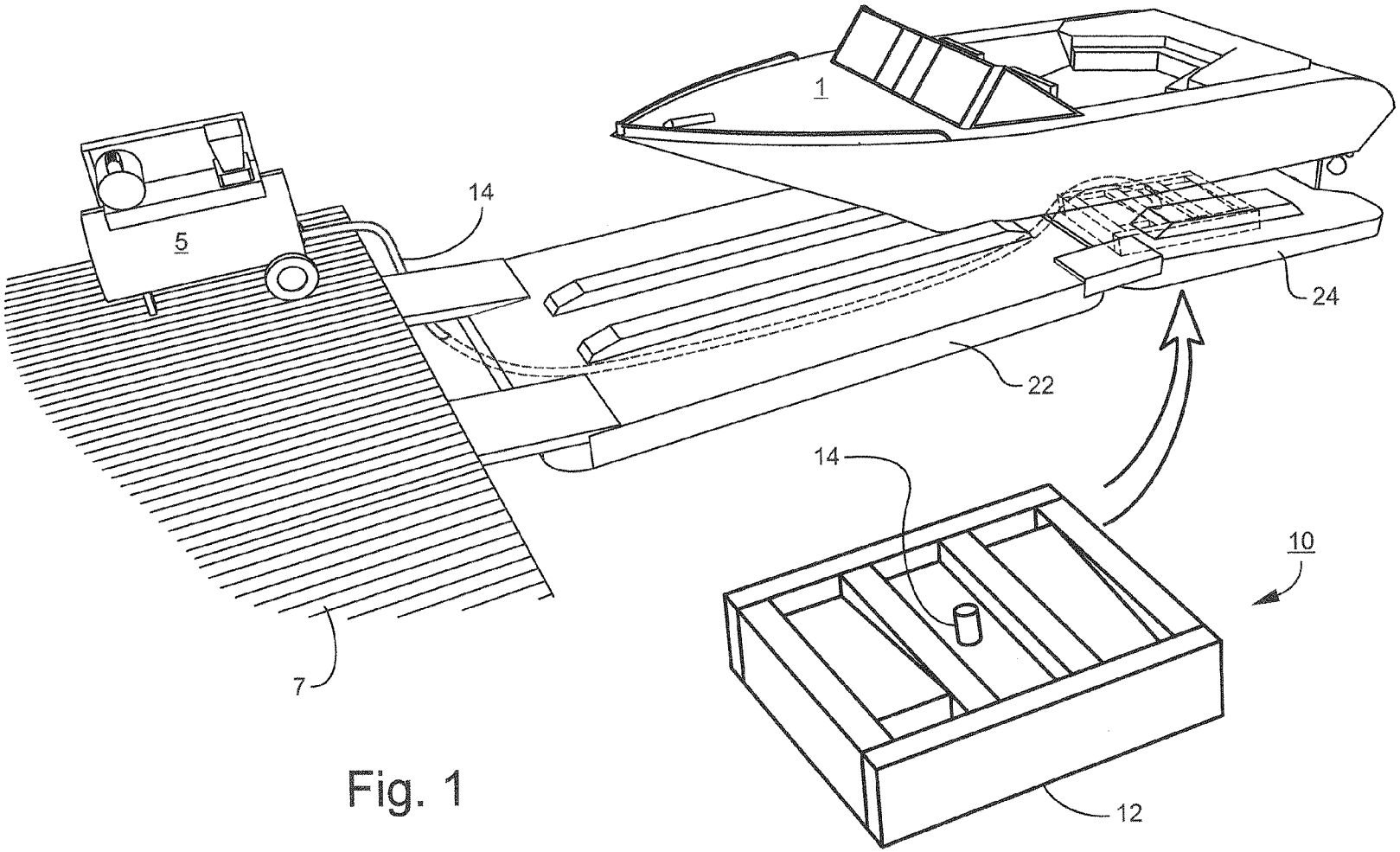
FIG. 1 is a perspective view of a self-leveling lift system according to an aspect of the disclosure.

Detailed reference will now be made to the drawings in which examples embodying the present subject matter are shown. The detailed description uses numerical and letter designations to refer to features of the drawings. Like or similar designations of the drawings and description have been used to refer to like or similar parts of various exemplary embodiments.

The drawings and detailed description provide a full and written description of the present subject matter, and of the manner and process of making and using various exemplary embodiments, so as to enable one skilled in the pertinent art to make and use them, as well as the best mode of carrying out the exemplary embodiments. However, the examples set forth in the drawings and in the detailed description are provided by way of explanation only and are not meant as limitations of the disclosure. The present subject matter thus includes any modifications and variations of the following examples as come within the scope of the appended claims and their equivalents.

Figure 2:
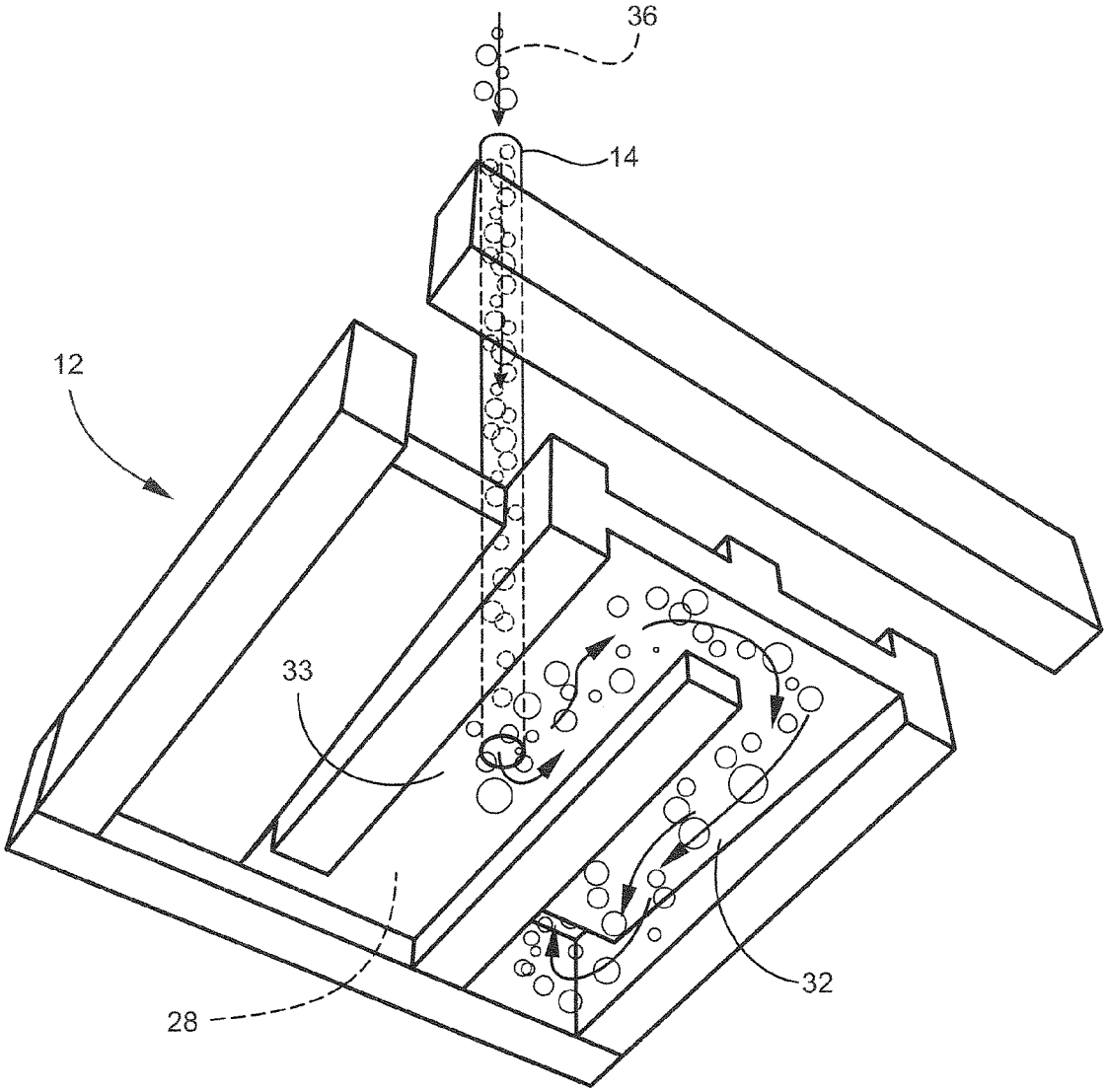
FIG. 2 is a partially exploded view of a portion of the self-leveling lift system as in FIG. 1.
Figure 3:
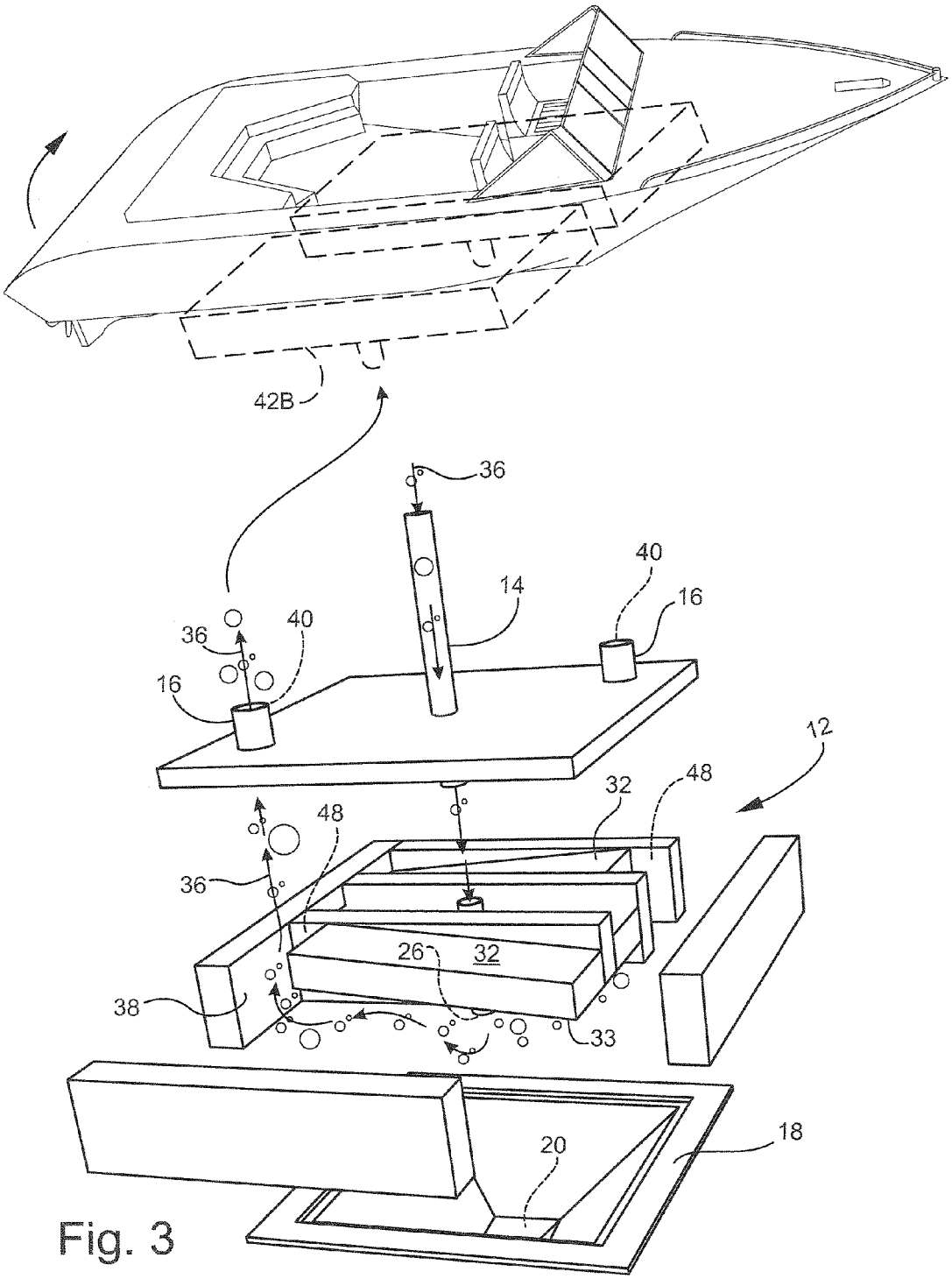
FIG. 3 is an exploded view of a portion of the system as in FIG. 1.

With reference to FIGS. 1, 2, and 3, a self-leveling lift is shown, which is designated in general by the number 10. The lift 10 broadly includes an air transfer device such as a plate or enclosure frame 12, an air supply pipe or hose 14, and an air diversion hose or pipe 16.

FIG. 1 particularly shows an application of the self-leveling lift 10 in an intended use environment. In this example, a drive-on boat dock has sections 22, 24 to accommodate a boat 1. Here, section 22 is attached to a pier or landing 7. The enclosure 12 is positioned under the section 24 in communication with an air compressor or pump 5 via the hose 14. The hose 14 acts as a conduit between the air compressor 5 and the enclosure 12. As shown in FIG. 2, air 36 is pumped into a space 28 via the pipe 14. Depending on the orientation or tilt of the enclosure 12, the air 36 will flow under a ramp 32 along a surface 33 of the enclosure 12.

As best shown in FIG. 3, a ramp system of the enclosure 12 has two ramps 32 that are oriented at different angles. The ramps 32 may be offset from each other from about 30 to about 45 degrees, though greater or lesser offsets may be provided to accommodate different dock designs and/or their flotation compartments. In this example, each ramp 32 leads to and opens into respective slots 48. As shown here, a natural tilt of the boat 1 as briefly introduced above will cause the air 36 to select the surface 33 (see FIG. 2) nearest to the ramp 32 opening into the slot 48 that in turn opens into the most submerged portion or air compartment of the section 24 (rather than the slot 48 of the other ramp 32 leading into a less submerged portion). The air 36 proceeds to the respective outlet 40 and is directed to the most submerged part of section 24 (see FIG. 1). In other words, the air 36 naturally seeks a path leading toward the surface of the water, which in this example would be upward toward the bow of the boat. However, the ramps 32 of the enclosure 12 take advantage of the nature of the air 36 and redirect it along the surface 33 toward the slot 48 leading into the most submerged compartment of the section 24. Here, tank or air cavity 42B (as described in further detail relative to FIG. 4 below) is the most submerged compartment due to the greater weight at the stern of the boat in this example.

It will be appreciated that the ramp system of the dock leveling system 12 may have, for instance, four ramps 32 in which two of the ramps 32 may be oriented from port to starboard (side to side) relative to the boat 1, and two ramps 32 may be oriented from fore to aft; i.e., perpendicular to the first two ramps 32 and parallel to the boat 1. In this manner, the dock leveling system 12 can be used to level a dry dock and the boat thereon either lengthwise or from side to side or in both directions. It will be further appreciated that although the dock leveling system 12 in FIGS. 1, 2 and 3 is shown in communication with section 24, the dock leveling system 12 may be positioned to also level section 22 or another system 12 may be installed under section 22 separate from the system 12 under section 24.

FIG. 3 further shows a barnacle shield 18 having an aperture 20 formed therein to permit water to enter the space 28. However, the aperture 20 is sized to restrict water circulation to prevent sufficient nutrients from entering in and circulating under and within the enclosure 12 thus inhibiting barnacles and other marine life from growing and blocking, for instance, the various apertures 26, 40 and 48. As shown, the barnacle shield 18 may be connected to a skirt 38 of the enclosure 12 by screws, clamps, latches and the like, or the skirt 38 may be formed or molded in one piece with the enclosure 12. Preferably, the components are made of materials resistant to marine life. The components also resist deterioration during long term exposure to water, especially brackish or salt water. Exemplary materials that may be used to make the enclosure 12, the shield 18, tubes 14, 16 and other components of the disclosure may include high density polyethylene (HDPE), polyethylene, polypropylene, polyvinyl chloride, and/or other types of durable plastics that may be molded, drilled and the like. Additionally, although each slot 48 is shown in FIG. 3 having a rectangular shape, the slot 48 may be circular or have other shapes to complement, for instance, different types of pipes, such as the pipe 16.

Figure 4:
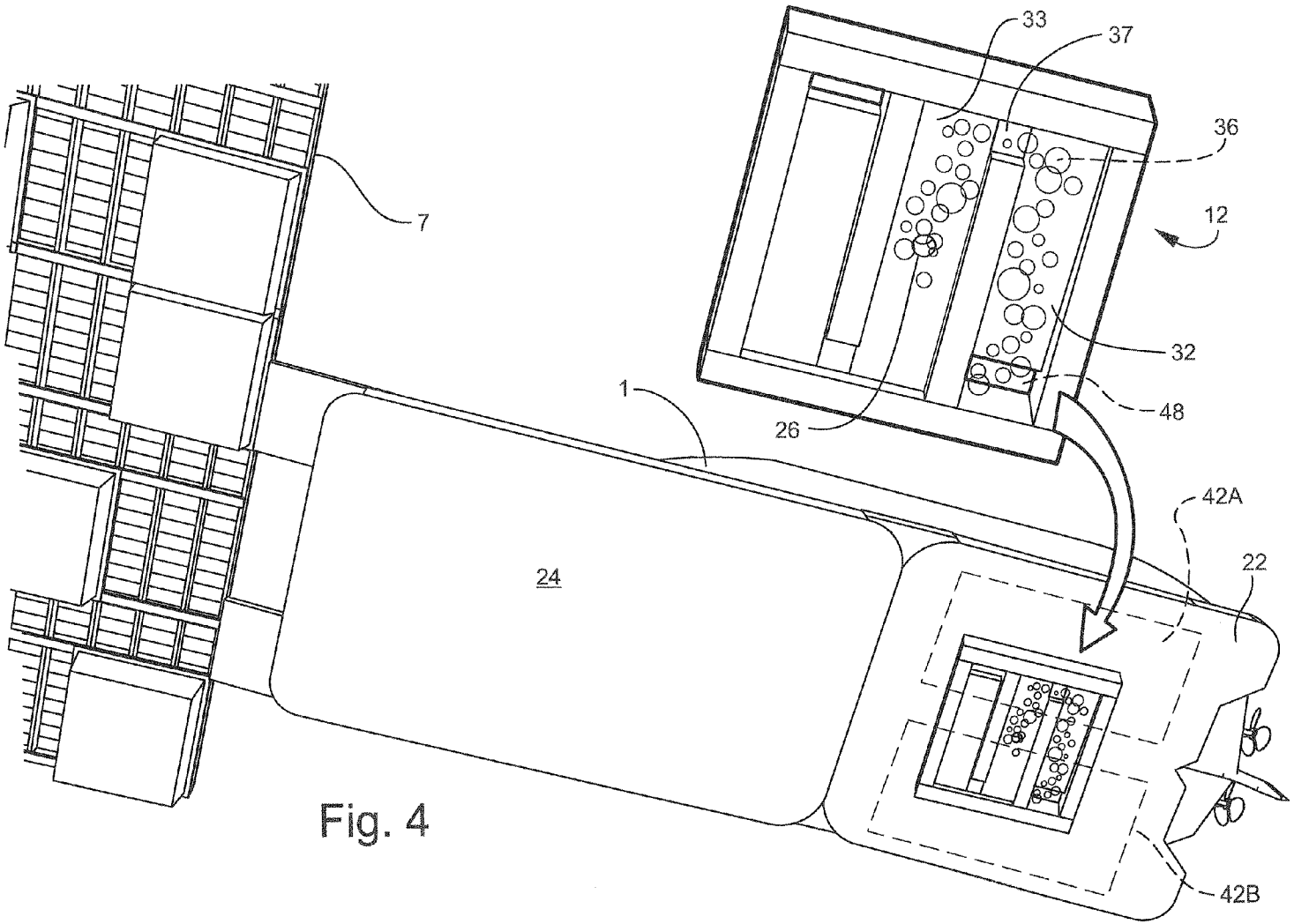
FIG. 4 is a bottom perspective view of the self-leveling lift system as shown in FIG. 1.

FIG. 4 is a bottom view of the arrangement shown in FIG. 3. Here, tanks or air cavities 42A, 42B may be formed within or fitted under the section 22. The enclosure 12 is connected below and in fluid communication with the tanks 42A, 42B. As shown, the ramp 32, the surface 33 and a gate 37 of the enclosure 12 direct the air 36 toward the opening 48, which corresponds to the more depressed or submerged tank 42B of the section 22. Stated another way, although tank 42A is closer to the water surface, the angled ramp 32 transfers the air 36 into the more depressed tank 42B to level the boat 1.

Figure 5:
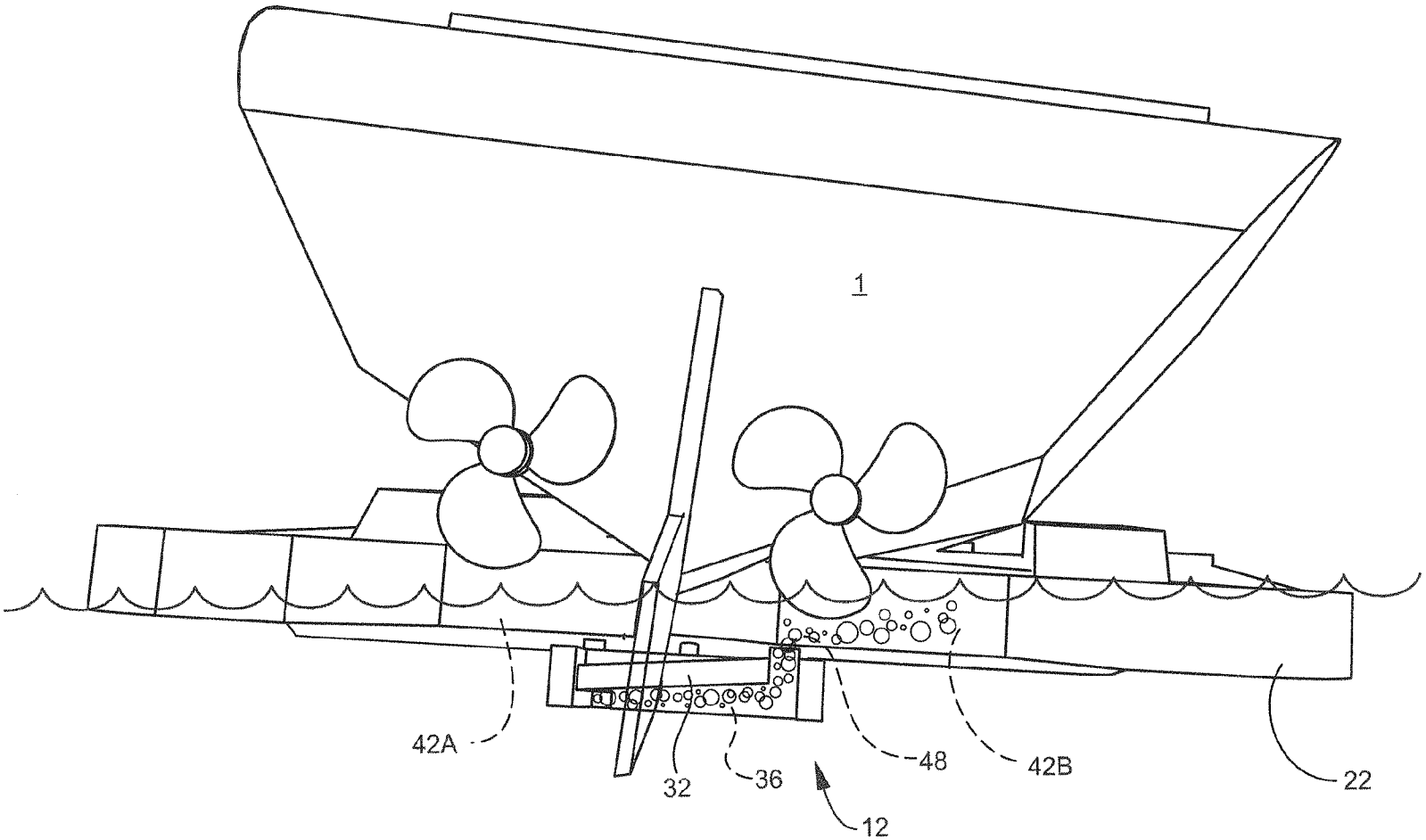
FIG. 5 is a rear elevational view of an exemplary operation of the self-leveling lift system of FIG. 4.

FIG. 5 is a rear view of the arrangement of FIG. 4. As noted above, the air 36 is forced to follow the ramp 32 toward the opening 48 corresponding to the tank 42B of the section 22. Again, although the tank 42A is higher, the angled ramp 32 forces the air 36 into the lower tank 42B to level the boat 1. In this example, the tanks 42A, 42B are formed within the section 22 but the tanks 42A, 42B may be separate and installed below an existing boat ramp or section thereof.

Figure 6:
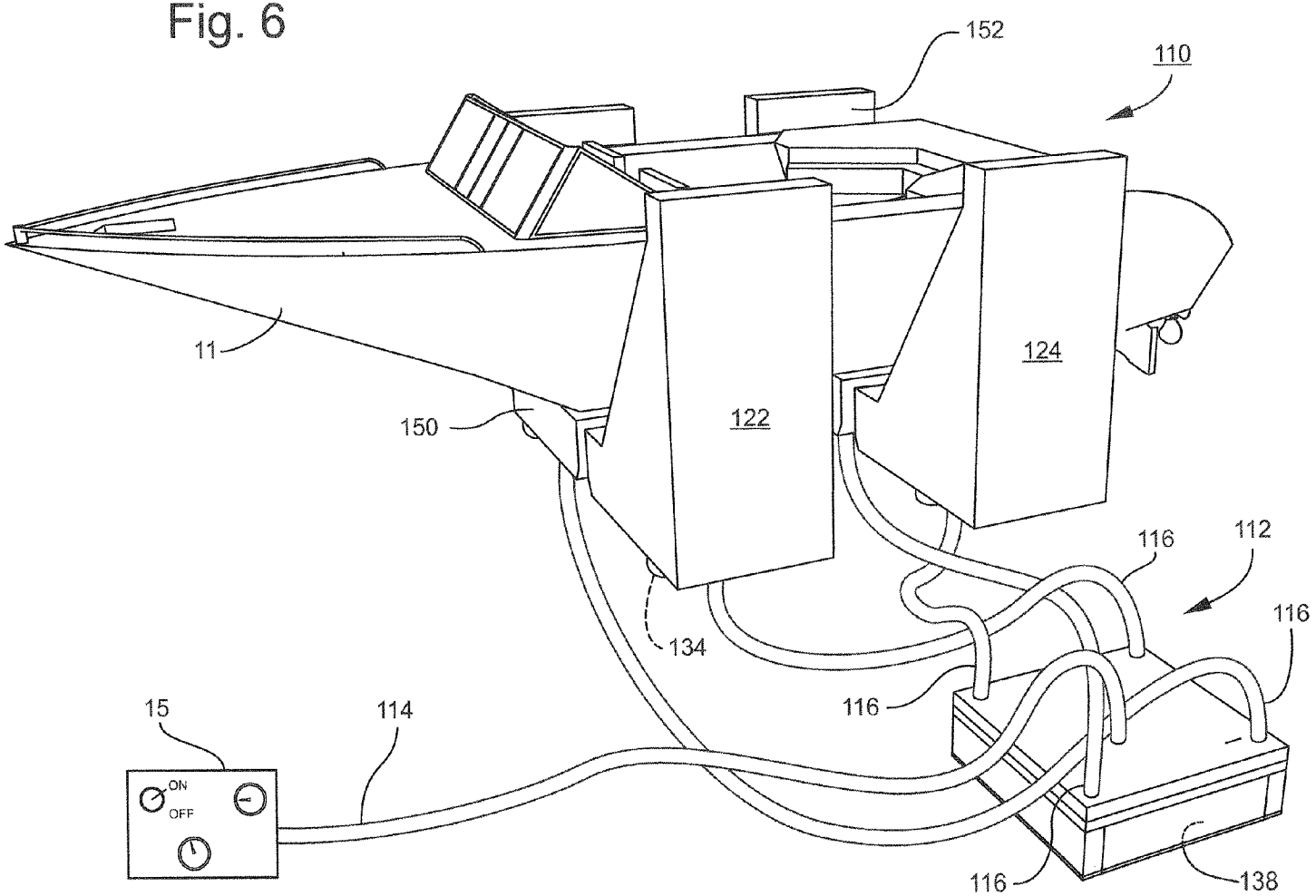
FIG. 6 is a perspective view of another self-leveling lift system according to the disclosure.

FIG. 6 shows another embodiment of a self-leveling lift 110 having, in this example, four flotation chambers or floats 122, 124, 150, 152, each having an opening 134 to water. Each of the floats 122, 124, 150, 152 is in communication with the lift enclosure 112 via respective hoses 116. As shown, the lift 110 includes a plate 112 having a perimeter 138 for directing air supplied from an air pump 15 through a hose 114 into the plate 112. For clarity the lift 110 is shown free standing but may be, in operation, fixed or attached to the lift 110 or otherwise disposed proximate the floats 122, 124, 150, 152. Moreover, although the hoses 116 are shown in this example as being attached above the perimeter 138, the hoses 116 may instead by connected elsewhere, such as within the perimeter 138 itself.

Figure 7:
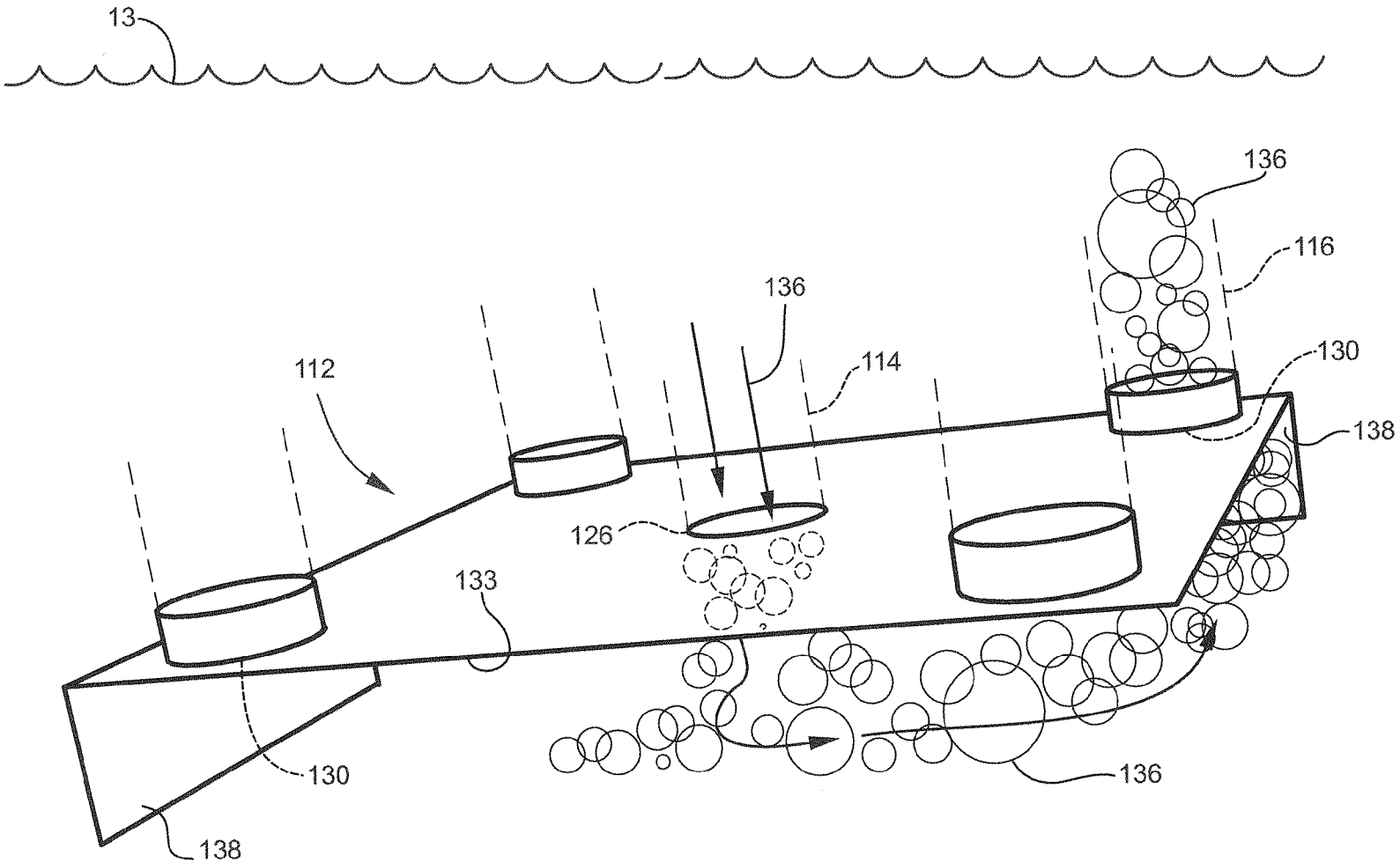
FIG. 7 is a schematic sectional view of a component shown in FIG. 6.

FIG. 7 is a partially cutaway schematic view of the enclosure 112 of FIG. 10. Here, air 136 is delivered from the hose 114 through an aperture 126 in the plate 112. The air 136, by nature, tracks along a surface 133 toward one of the more elevated apertures 130 for redirecting the air 136 to the lowest tank (see, e.g., float 152 of FIG. 6). Also shown is the perimeter wall or skirt 138 that contains the air within the enclosure 112 near the surface 133 until the air 136 reaches the appropriate aperture 130. The skirt 138 is of sufficient depth or height, i.e., extending from the surface 133, to prevent the air 136 from escaping to the water 13.

Figure 8:
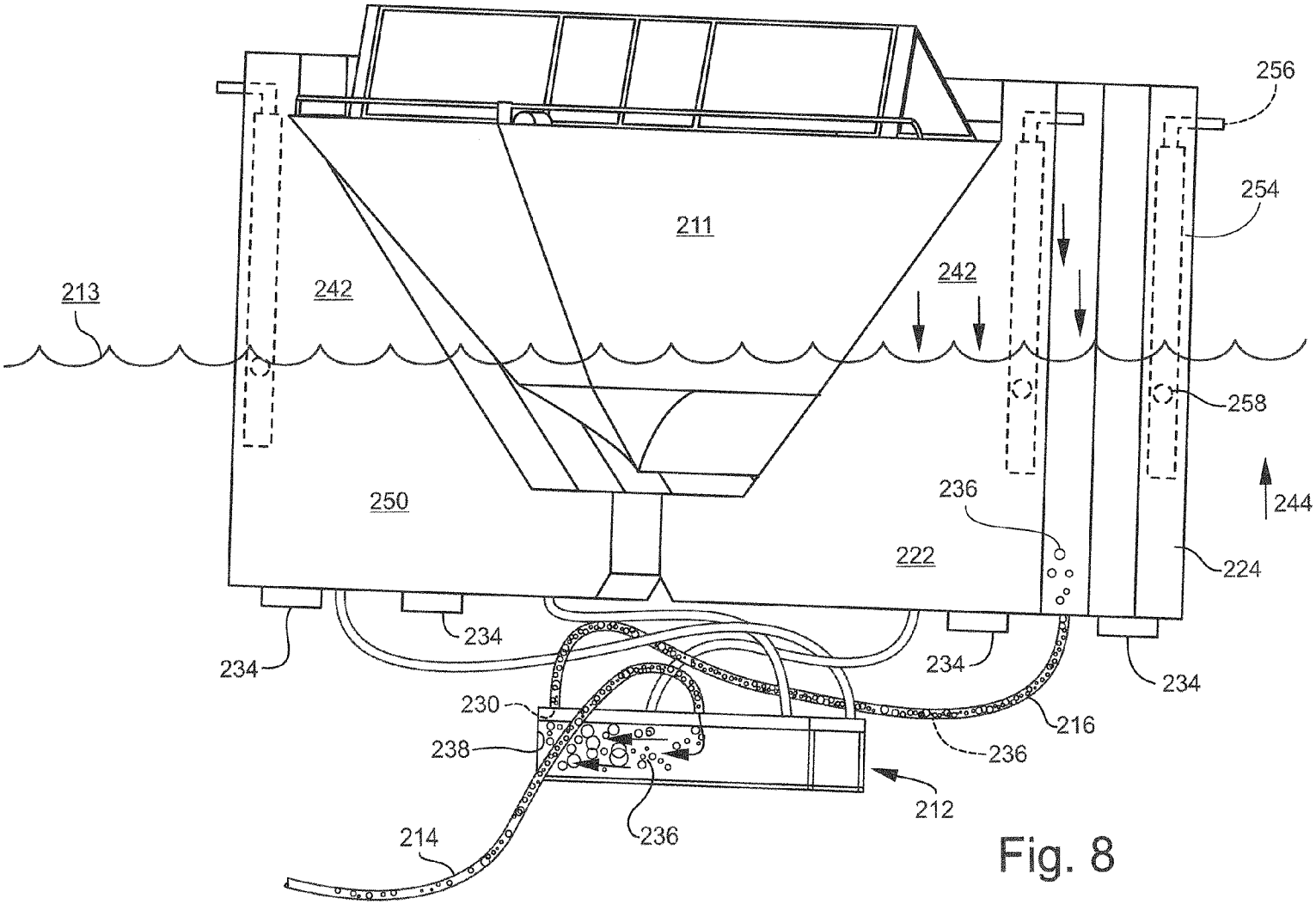
FIG. 8 is a perspective view of another aspect of a dry dock system, particularly showing an exemplary operation of a depth setting device.

Turning to FIG. 8, as air 236 is pumped into an enclosure 212 in another aspect of the disclosure, the air 236 enters into an air chamber 242 of a respective float 222, 224, 250, 252 that is most submerged or depressed in a body of water 213. As shown, the air 236 proceeds toward a side of the enclosure 212 and is guided by a perimeter wall 238 into an opening 230 and further into a hose 216 feeding into the lowest air chamber 242. As the air 236 fills the lowest chamber 242, the water level in the chamber 242 lowers as water is pushed out of a respective opening 234 thereby leveling and raising the lift 210 and the boat 211 thereon as indicated by arrow 244. Also shown in FIG. 8 are level or depth setting pipes 254 installed in chambers 242. Each pipe 254 has an air outlet 256 and a depth setting aperture 258, which are described below.

Figures 9A, 9B:
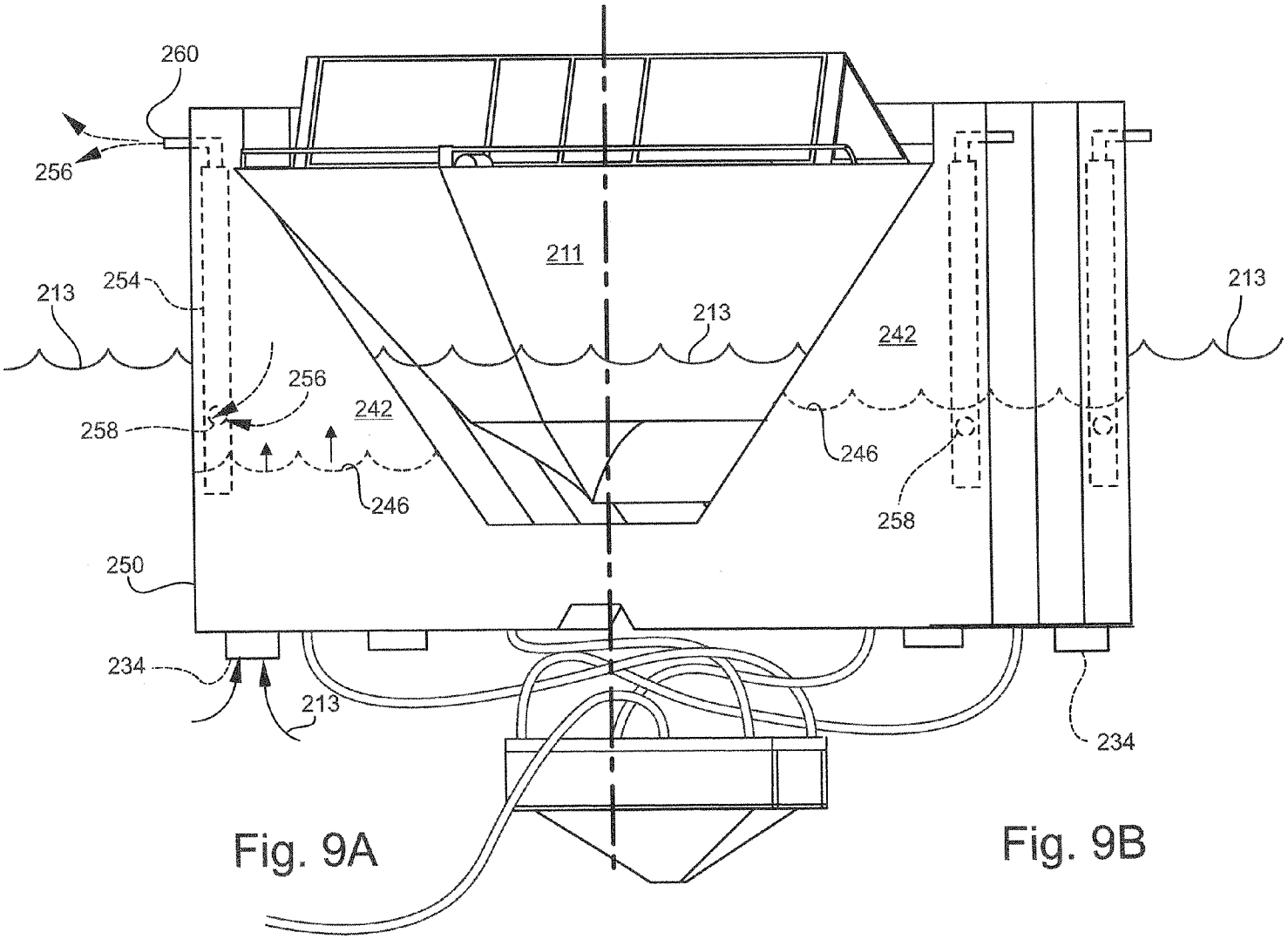
FIGS. 9A and 9B show completion of the exemplary operation of the system as in FIG. 8.

Turning to FIGS. 9A and 9B, the level or depth setting pipes 254 introduced above are shown in operation. In FIG. 9A the level-set pipe 254 includes a tap-out hole or level setting switch 258. While the water level 246 in the tank 250, for example, is below the tap-out hole 258 during a first condition or state, the water 213 may continue to enter the tank 250 through the orifice 234 while air 256 in the chamber 242 enters the tap out hole 258 and exits the tank 250 from a vent pipe or hole 260 in communication with the pipe 254. The combined effect of the entering water 213 and escaping air 156 causes the tank 250 to sink. However, as FIG. 9B shows, once the tap out hole 258 is below the water level 246 in a second condition or state, no further air can escape from the chamber 242. The remaining air 256 trapped in the chamber 242 cannot be compressed by the water 246 so the chamber 242 hydraulically locks ("hydro-locks"); i.e., the water 246 stops rising as no more water 213 can enter through the orifice 234. Those skilled in the art will appreciate that the tap out hole 258 can be selected by the boat owner to accommodate a particular boat draft such that the lift 210 floats at a predetermined level without having to completely fill the water the chamber 242 each time the boat 211 is ready for dry docking. Furthermore, the tap out hole 258 may be drilled in the cylinder 254 or a cock valve or plug may be used, which is removed to accommodate a specific boat draft. Moreover, although a cylinder 254 with a round tap hole 258 is shown by way of example, the shapes may be modified to accommodate, for instance, a particular float shape, capacity or dimension.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

That which is claimed is:

1. A dry dock stabilizer disposed proximate a surface of a body of water, the dry dock stabilizer comprising:

a flotation chamber; and an air transfer device in communication with an air source, the air transfer device disposed proximate the flotation chamber, the air transfer device defining an enclosure configured to mimic an orientation of the flotation chamber, the enclosure including a plate having a skirt depending therefrom, the skirt being configured to direct the air from the air source to the flotation chamber, the flotation chamber and the air transfer device, when imbalanced, defining respective lower points, the air transfer device further defining a higher point and being configured to transfer air away from the higher point to the lower point of the flotation chamber.

2. The dry dock stabilizer as in claim 1, wherein the flotation chamber is at least two flotation chambers and the enclosure defines at least three openings, the first opening being in communication with the air source and the second and third openings being in respective communication with the two flotation chambers.

3. The dry dock stabilizer as in claim 2, further comprising a conduit connected between the air source and the first opening.

4. The dry dock stabilizer as in claim 2, further comprising a first hose and a second hose, the first hose being connected between the second opening and one of the two flotation chambers, the second hose being connected between the third opening and the other of the two flotation chambers.

5. The dry dock stabilizer as in claim 2, wherein one of the two flotation chambers defines a lowest point corresponding to the higher point of the air transfer device.

6. The dry dock stabilizer as in claim 1, wherein the flotation chamber is configured to raise a water craft above a water surface.

7. The dry dock stabilizer as in claim 1, wherein the enclosure is disposed in a body to water and open thereto.

8. The dry dock stabilizer as in claim 1, further comprising a shield attachable to the enclosure, the shield including an aperture to permit water entry but insufficient to sustain marine life.

9. The dry dock stabilizer as in claim 1, further comprising a depth setting device disposed in the flotation chamber, the depth setting device having a hole configured to discharge air from the flotation chamber in a first state and configured to block air discharge in a second state.

10. A self-leveling docking system, comprising:

a plurality of flotation chambers; and an air direction system disposed proximate the flotation chambers, the air direction system including an air dispersion plate sympathetically oriented with the flotation chambers and in communication therewith, the air dispersion plate having a rim configured to guide air from an air supply and to direct the air to at least one of the flotation chambers disposed at a water level lower than the other flotation chambers: and a shroud, the air dispersion plate interposed between the shroud and the flotation chambers, the shroud in communication with a body of water but configured to restrict entry of nutrients from the water of body to discourage marine life growth proximate the air direction system.

11. The self-leveling docking system as in claim 10, wherein at least one flotation chamber has an aperture for water entry.

12. The self-leveling docking system as in claim 10, wherein the rim is appended to the air dispersion plate in a direction away from the flotation chambers.

13. The self-leveling docking system as in claim 10, wherein the air dispersion plate defines at least two holes therein, a first hole for air entry and a second hole to direct the air to the flotation chambers.

14. The self-leveling docking system as in claim 10, further comprising a depth setting device disposed in at least one flotation chamber.

15. A self-leveling flotation system, comprising:

a plurality of flotation chambers disposed in a body of water; and means for guiding air from an air supply to at least one of the flotation chambers, the means for guiding being disposed proximate the flotation chambers and movable according to an orientation of the flotation chambers such that the air travels from a high point of the means for guiding to a lower point of the flotation chambers, wherein the means for guiding is an enclosure and further comprising a shield connected to the enclosure, the shield including an aperture to hermit water entry but insufficient in size to sustain marine life.

16. The self-leveling flotation system as in claim 15, further comprising a depth setting device disposed in at least one of the flotation chambers, the depth setting device having an opening also disposed in the flotation chamber, the opening configured to transfer air from the at least one flotation chamber in a first state and configured to halt transfer of air from the at least one flotation chamber in a second state.

17. A dry dock lift disposed proximate a surface of a body of water, the dry dock lift comprising:

at least two flotation chambers positioned under or within a dry dock disposed in water; and a dry dock leveling device having a ramp system disposed therein, the dry dock leveling device in communication with an air source and the two flotation chambers;

wherein, when a boat is disposed on the dry dock, the two flotation chambers mimic an orientation of the dry dock, one of the two flotation chambers defining a lowest submerged point in the water, and wherein the ramp system has at least two ramps oriented at different angles, the air following one of the ramps leading to the lowest submerged point thereby elevating the lowest submerged point and leveling the dry dock, wherein each of the two ramps are in communication with a respective one of the two flotation chambers to level the flotation chambers fore and aft, port and starboard, or combinations thereof.

18. The dry dock lift as in claim 17, wherein the two ramps are disposed proximate each other at opposite angles.

19. A dry dock stabilizer disposed proximate a surface of a body of water, the dry dock stabilizer comprising:

a flotation chamber;

an air transfer device in communication with an air source, the air transfer device disposed proximate the flotation chamber, the air transfer device defining an enclosure configured to mimic an orientation of the flotation chamber, the enclosure including a redirection structure disposed therein, the redirection structure being configured to direct the air from the air source to a periphery of the enclosure, the redirection structure further including a slot configured to direct the air from the air source to an opening in the flotation chamber, the flotation chamber and the air transfer device, when imbalanced, defining respective lower points, the air transfer device further defining a higher point and being configured to transfer air away from the higher point to the lower point of the flotation chamber.

20. A dry dock stabilizer disposed proximate a surface of a body of water, the dry dock stabilizer comprising:

a flotation chamber;

an air transfer device in communication with an air source, the air transfer device disposed proximate the flotation chamber, the air transfer device defining an enclosure configured to mimic an orientation of the flotation chamber, the flotation chamber and the air transfer device, when imbalanced, defining respective lower points, the air transfer device further defining a higher point and being configured to transfer air away from the higher point to the lower point of the flotation chamber, wherein the enclosure includes a redirection structure disposed therein, the redirection structure having a plurality of ramps and being configured to direct the air from the air source to a periphery of the enclosure.

* * * * *